US009393807B2

(12) United States Patent
Miyashita

(10) Patent No.: US 9,393,807 B2
(45) Date of Patent: Jul. 19, 2016

(54) RECORDING APPARATUS

(71) Applicant: SEIKO EPSON CORPORATION, Tokyo (JP)

(72) Inventor: Daisuke Miyashita, Shiojiri-shi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/570,563

(22) Filed: Dec. 15, 2014

(65) Prior Publication Data

US 2015/0183236 A1 Jul. 2, 2015

(30) Foreign Application Priority Data

Dec. 26, 2013 (JP) ..... 2013-268719

(51) Int. Cl.
*B41J 11/00* (2006.01)
*B41J 29/02* (2006.01)

(52) U.S. Cl.
CPC ..... *B41J 11/0015* (2013.01); *B41J 29/02* (2013.01)

(58) Field of Classification Search
CPC ..... B41J 11/0015; B41J 29/02
USPC ..... 347/16, 101, 8
See application file for complete search history.

(56) References Cited

U.S. PATENT DOCUMENTS

| | | | | |
|---|---|---|---|---|
| 4,361,845 | A | 11/1982 | Smith | |
| 5,774,141 | A | 6/1998 | Cooper et al. | |
| 6,390,618 | B1 | 5/2002 | Wotton et al. | |
| 7,044,581 | B2 | 5/2006 | Shimoyama | |
| 2001/0012048 | A1* | 8/2001 | Kinjyou et al. | 347/262 |
| 2006/0092217 | A1 | 5/2006 | Valles et al. | |
| 2007/0097162 | A1* | 5/2007 | Iwashita et al. | 347/9 |
| 2009/0058895 | A1* | 3/2009 | Kida | 347/8 |
| 2010/0165063 | A1* | 7/2010 | Abramovitch | 347/101 |
| 2011/0069115 | A1 | 3/2011 | Tanabe et al. | |

FOREIGN PATENT DOCUMENTS

| | | | |
|---|---|---|---|
| EP | 1652675 | A1 | 5/2006 |
| JP | 2005-271316 | | 10/2005 |
| JP | 2006-123555 | | 5/2006 |
| JP | 2008-213310 | | 9/2008 |
| JP | 05-195397 | | 2/2013 |
| JP | 5195397 | B | 2/2013 |
| JP | 2013-107330 | | 6/2013 |

OTHER PUBLICATIONS

U.S. Appl. No. 13/158,922, filed Sep. 19, 2012, Office Action.
U.S. Appl. No. 13/158,922, filed Jan. 8, 2013, Final Office Action.
U.S. Appl. No. 13/158,922, filed May 30, 2014, Office Action.
U.S. Appl. No. 13/158,922, filed Sep. 17, 2014, Final Office Action.

* cited by examiner

*Primary Examiner* — Jason Uhlenhake
(74) *Attorney, Agent, or Firm* — Workman Nydegger

(57) ABSTRACT

A recording section that performs recording on a recording medium, a static eliminator that eliminates static electricity from the recording medium, and a moving section that moves the static eliminator with respect to the recording section are provided.

8 Claims, 7 Drawing Sheets

RECORDING APPARATUS

CROSS-REFERENCE TO RELATED APPLICATIONS

The present application claims priority to Japanese Patent Application No. 2013-268719 filed on Dec. 26, 2013, which is hereby incorporated by reference in its entirety.

BACKGROUND

1. Technical Field

Embodiments of the present invention relates to a recording apparatus.

2. Related Art

Recording apparatuses have been used to perform recording on recording media or medium. In such recording apparatuses, the recording medium may be electrostatically charged. As a result, the recording medium may be contaminated as a result of airborne matter such as dirt, dust, and ink mist attaching to the electrostatically charged recording medium. To prevent the recording medium from becoming contaminated, for example, JP-A-2013-107330 discloses a recording apparatus that includes an ionizer. The ionizer functions as a static eliminator in order to inhibit airborne ink mist from attaching to the electrostatically charged recording medium.

However, in recent years, recording media having various thicknesses have been used. In the recording apparatus of the related-art such as disclosed in JP-A-2013-107330, depending on the recording medium being used, the distance between the recording medium and the static eliminator might not be appropriate. In such a case, the static eliminator might not efficiently inhibit contamination of the recording medium. As a result, airborne matter such as dirt, dust, and ink mist may attach to the electrostatically charged recording medium.

For example, when an ionizer is used as a static eliminator, if the distance between the recording medium and the static eliminator is too large, it is difficult for a sufficient amount of ions to reach the recording medium. If the distance between the recording medium and the static eliminator is too small, the ions do not sufficiently spread across the entire recording medium. As a result, the static electricity may be unevenly eliminated. This may generate effectively eliminated areas and non-eliminated areas on the recording medium.

In addition, the appropriate distance between the recording section and the static eliminator in the transport direction of the recording medium may vary with the type of recording medium.

In the recording apparatus disclosed in JP-A-2013-107330, the ionizer is positionally fixed. As a result, it can be difficult to successfully eliminate static electricity from the recording medium because a moving mechanism for the ionizer is not provided.

SUMMARY

An advantage of some embodiments of the invention is to efficiently inhibit contamination of the recording medium that results from airborne matter such as dirt, dust, and ink mist attaching to the electrostatically charged recording medium.

According to an embodiment of the invention, a recording apparatus may include a recording section that performs recording on a recording medium, a static eliminator that eliminates static electricity from the recording medium, and a moving section that moves the static eliminator with respect to the recording section.

According to one embodiment, the recording apparatus may include the moving section and the moving section moves the static eliminator with respect to the recording section. Thus, the static eliminator may be moved based on the thickness of the recording medium and the location at which it is desired to eliminate static electricity. Therefore, contamination of the recording medium caused by airborne matter such as dirt, dust, and ink mist attaching to the electrostatically charged recording medium may be efficiently inhibited or prevented.

In one example, the recording apparatus includes a detecting section that detects a distance between the recording medium and the recording section. The moving section moves the static eliminator toward and away from the recording medium depending on the distance detected by the detecting section.

According to the above, the moving section moves the static eliminator in the direction toward and away from the recording medium depending on the distance detected by the detecting section. Thus, even if the various recording media having different thicknesses are used, the static eliminator is moved toward and away from the recording medium depending on the thickness of each recording medium, so that the distance between the recording medium and the static eliminator may be appropriate.

As used herein, "the distance between the recording medium and the recording section" means the distance between the surface of the recording medium to be printed and, for example, the recording section that performs recording like a nozzle face of an ink jet recording head.

In one example, the recording apparatus includes a transport section that transports the recording medium. The moving section moves the static eliminator in a transport direction of the recording medium.

According to the above, the moving section moves the static eliminator in the transport direction of the recording medium. Thus, the static eliminator may be moved to an appropriate position in the transport direction.

In one example, the recording apparatus includes a transport section that transports the recording medium. The recording section includes a recording head including a nozzle face in which nozzles for discharging inks are disposed and a carriage that incorporates the recording head and that reciprocally moves in a direction intersecting with the transport direction of the recording medium.

In an ink jet recording apparatus that incorporates the recording head having the nozzle face in which the nozzles for discharging inks are disposed and that performs recording by reciprocally moving the recording head in the intersecting direction, the recording medium becomes electrostatically charged. Because the recording medium is electrostatically charged, airborne ink mist easily attaches to the recording medium.

However, according to the above, even in the recording apparatus having such a configuration, static electricity may be efficiently eliminated from the recording medium and contamination of the recording medium caused by attached ink mist may be efficiently inhibited.

In one example, the recording section include a recording head having a nozzle face in which nozzles for discharging inks are disposed, and a carriage that incorporates the recording head and reciprocally moves in a direction intersecting with the transport direction of the recording medium.

In the ink jet recording apparatus that incorporates the recording head having the nozzle face in which the nozzles for discharging inks are disposed and that performs recording by reciprocal movement of the recording head in the intersecting direction, the recording medium becomes electrostatically charged. As a result, airborne ink mist easily attaches to the recording medium.

However, according to the above, even in the recording apparatus having such a configuration, static electricity may be efficiently eliminated from the recording medium and contamination of the recording medium caused by attached ink mist may be efficiently inhibited.

In one example, the static eliminator may be incorporated in the carriage.

According to the above, the static eliminator may be incorporated in the carriage. Thus, static electricity may be efficiently eliminated from the recording medium immediately before the recording head discharges inks. As a result, contamination of the recording medium caused by the attachment of ink mist may be efficiently inhibited.

In one example, the static eliminator may be provided at each end of the recording head in the intersecting direction.

According to the above, the static eliminator may be provided at each end of the recording head in the intersecting direction. Thus, whichever direction along the intersecting direction the static eliminator moves, the static eliminator may efficiently eliminate static electricity from the recording medium in an appropriate position with respect to the recording section in the transport direction immediately before the recording head discharges inks. Therefore, contamination of the recording medium caused by the attachment of ink mist may be efficiently inhibited.

In one example, the recording apparatus include a controller that controls driving of the static eliminator or that controls the static eliminator.

As used herein, "controlling driving of the static eliminator" includes, other than on/off control of the static eliminator, control of the intensity of the operation of the static eliminator or the like.

In one example, the recording apparatus includes the controller that controls the driving of the static eliminator or that controls the static eliminator. Thus, static electricity is efficiently eliminated from the recording medium. When the recording medium is less likely to be electrostatically charged and elimination of static electricity is unnecessary, the static eliminator may be, for example, turned off to reduce an electricity expense. In addition, when the static eliminator is continuously on, the static eliminator is likely to be contaminated as a result of airborne matter such as dirt, dust, and ink mist attaching to the static eliminator. However, when elimination of static electricity is unnecessary, for example, the static eliminator may be turned off. Turning the static eliminator off reduced the likelihood that the static eliminator will be contaminated.

In one example, the controller controls the driving of the static eliminator based on at least one of information on a type of the recording medium, information on an installation location of the recording apparatus, information on date and time, and information on environmental humidity.

In one example, the controller controls the driving of the static eliminator based on at least one of information on a type of the recording medium, information on an installation location of the recording apparatus, information on date and time, and information on environmental humidity. Therefore, on the basis of at least one of the type of the recording medium, the installation location of the recording apparatus, and date and time and the environmental humidity it may be easily recognized when the recording medium is less likely to be electrostatically charged and, accordingly, when elimination of static electricity is unnecessary.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

A recording apparatus according to embodiments of the invention will be described in detail with reference to the accompanying drawings.

First, a recording apparatus according to an embodiment of the invention will be described.

Figure 1:
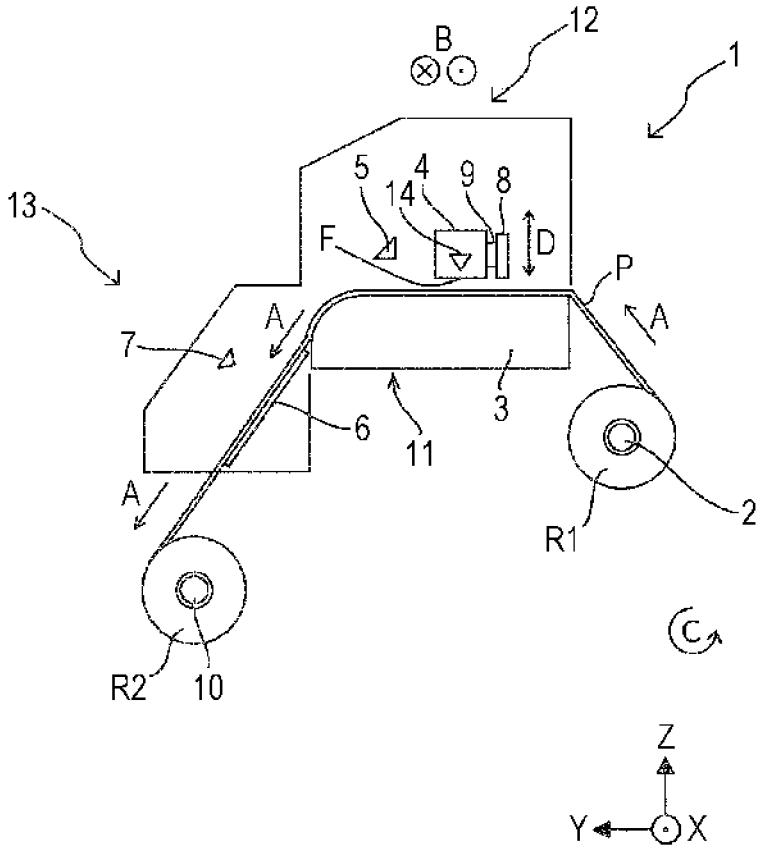
FIG. 1 is a schematic side view illustrating an example of a recording apparatus.

FIG. 1 illustrates a schematic side view of an embodiment of a recording apparatus 1.

The recording apparatus 1 may include a supporting shaft 2 that supports a roll R1 of a recording medium P on which recording is to be performed. The supporting shaft 2 of the recording apparatus 1 rotates in a rotation direction C when the recording medium P is transported in a transport direction A. A roll of the recording medium P is wound so that a recording surface of the medium P faces outward is used in this embodiment. When a roll of the recording medium P which is wound so that the recording surface of the medium P faces inward is used, the supporting shaft 2 may rotate in a direction opposite to the rotation direction C in which a length of the roll R1 is fed.

In addition, the recording apparatus 1 employs a roll of the recording medium serving as the recording medium P. However, the recording apparatus 1 is not limited to the recording apparatus employing such a roll of the recording medium. For example, the recording medium may be individual sheets of paper.

In addition, the recording apparatus 1 may include a transport mechanism 11. The transport mechanism 11 may include a plurality of transporting rollers (not shown) that transport the recording medium P in the transport direction A. The transport mechanism 11 may include a platen heater 5 that can heat the recording medium P supported on a platen 3.

The platen heater 5 may be an infrared heater that is disposed at a position facing the platen 3 and that can heat the surface of the recording medium P from 35° C. to 50° C. However, the platen heater 5 is not limited to such a heater and may be a heater that can heat the recording medium P from the platen 3 side. In one example, a wavelength of infrared rays emitted by the infrared heater falls within a range of 0.76 to 1000 μm. In general, infrared rays are classified into near-infrared rays, mid-infrared rays, and far-infrared rays, which have approximate wavelengths falling within the ranges of 0.78 to 2.5 μm, 2.5 to 4.0 μm, and 4.0 to 1000 μm, respectively, although classification criteria may vary. Above all things, mid-infrared rays may be used.

In addition, the recording apparatus 1 of one embodiment may include a recording mechanism 12. The recording mechanism 12 performs recording by reciprocal scanning of a recording head 4, functioning as a recording section incorporated in a carriage (not shown), in a direction B intersecting with the transport direction A of the recording medium P and by discharging inks from a plurality of nozzles in the nozzle face F. The recording apparatus 1 of one embodiment includes the recording mechanism 12 that performs recording by reciprocal scanning of the recording head 4.

However, as described below in one embodiment, the recording apparatus 1 may be a recording apparatus that includes a so-called line head provided with a plurality of nozzles for discharging inks in the direction B intersecting with the transport direction A.

As used herein, "a line head" is a recording head used in a recording apparatus in which a nozzle region formed along the direction B intersecting with the transport direction A of the recording medium P is arranged so as to be able to cover the entire recording medium in the direction B. In such a recording apparatus, one of the recording head and the recording medium is fixed and the other one is moved for image formation. The nozzle region of the line head in the direction B does not have to cover, in the direction B, the entire recording medium P on which the recording apparatus operates.

It is also possible that the nozzle region of the recording head may be arranged so as to cover the entire recording medium P in the direction B intersecting with the transport direction A of the recording medium P. It may also be possible that both the recording head and the recording medium move for image formation.

The recording apparatus 1 may include the carriage that incorporates a static eliminator 8 and a moving section 9. The static eliminator 8 eliminates static electricity from the recording medium P and the moving section 9 moves the static eliminator 8 in a direction D with respect to the recording head 4. In one embodiment, the direction D is parallel to a vertically upward direction Z, the transport direction A of the recording medium P on the platen 3 is a horizontal direction Y from a rear side toward a front side of the recording apparatus 1, and the direction B in which the recording head 4 reciprocates is parallel to a direction X. The direction X is perpendicular to the vertically upward direction Z and the direction Y. However, the recording apparatus 1 is not limited to such a configuration.

As described above, the recording apparatus 1 may include the recording head 4 that performs recording on the recording medium P, the static eliminator 8 that eliminates static electricity from the recording medium P, and the moving section 9 that moves the static eliminator 8 with respect to the recording head 4. That is, this configuration can cause the moving section 9 to modify the relative positions of the static eliminator 8 and the recording head 4. For example, the static eliminator 8 may be moved depending on the thickness of the recording medium P and the location at which it is desired to eliminate static electricity. Therefore, this configuration may efficiently inhibit contamination of the recording medium P would be caused by airborne matter such as dirt, dust, and ink mist attaching to the electrostatically charged recording medium P.

An optical sensor 14 functions as a detecting section that detects the distance between the recording medium P and the recording head 4. The optical sensor 14 is disposed at an end of the recording head 4 in the direction B. The controller 20 described below (see FIG. 3) controls the moving section 9 so as to move the static eliminator 8 with respect to the recording head 4 in the direction D toward and away from the recording medium P depending on the distance detected by the optical sensor 14. More specifically, the moving section 9 may be controlled so as to move the static eliminator away from the recording medium P or controlled so as to move the static eliminator 8 towards the recording medium P.

Thus, even if various recording media P having different thickness are used, the static eliminator 8 is moved with respect to the recording head 4 in the direction D toward and away from each of the recording media P depending on the thickness of the recording medium P so that the distance between the recording medium P and the static eliminator 8 is appropriate. The direction of movement in the D direction (towards or away from the recording medium P) may depend on the present position of the static eliminator 8 and other information such as the thickness of the recording medium P or other factors.

In one embodiment, the distance between the recording medium P and the recording head 4 refers to the amount of clearance between the nozzle face F and the surface of the recording medium P to be printed.

As described above, the recording apparatus 1 may include a transport mechanism 11 functioning as a transport section that transports the recording medium P. The recording head 4 includes a nozzle face F in which the nozzles for discharging inks are disposed. The recording apparatus 1 includes a carriage that incorporates the recording head 4 and reciprocates in the direction B intersecting with the transport direction of the recording medium P.

In the ink jet recording apparatus that incorporates the recording head 4 having the nozzle face F in which the nozzles discharging inks are disposed and performs recording by reciprocal movement of the recording head 4 in the direction B, the recording medium P may become electrostatically charged. As a result of becoming electrostatically charged, airborne ink mist easily attaches to the recording medium P.

However, in one embodiment, even if the recording apparatus 1 is an ink jet recording apparatus, static electricity may be efficiently eliminated from the recording medium. Therefore, contamination of the recording medium caused by attached ink mist may be efficiently inhibited or prevented.

As described above, the static eliminator 8 may be incorporated in the carriage. Consequently, the static eliminator 8 efficiently eliminates static electricity from the recording medium P immediately before the recording head 4 discharges ink. Thus, contamination of the recording medium P caused ink mist attaching to the recording medium P may be efficiently inhibited.

A drying mechanism 13 that dries the recording medium P transported on a medium supporting section 6 is provided downstream of the transport mechanism 11 and the recording mechanism 12 in the transport direction A of the recording medium P. The drying mechanism 13 may include an afterheater 7 such as an infrared heater functioning as a drying section. The afterheater 7 is an infrared heater that can heat the surface of the recording medium P from 60° C. to 120° C. in order to dry the inks used in the recording apparatus 1, but is not limited to such a heater. In addition, the drying section may be a blower or the like such as a fan, other than (or in addition to) a heating device such as an infrared heater.

In addition, a winding shaft 10 that can wind the recording medium P into a roll R2 is provided downstream of the drying mechanism 13 in the transport direction A of the recording medium P. In one embodiment, a roll of the recording medium P which is wound so that a recording surface of the medium P faces outward is used. In this example, the winding shaft 10 rotates in the rotation direction C to wind the recording medium P. On the other hand, when a roll of the recording medium P which is wound so that the recording surface of the medium P faces inward is used, the winding shaft 10 rotates in a direction opposite to the rotation direction C so as to wind the roll R1.

A configuration of the moving section 9 for the static eliminator 8 in the recording apparatus 1 be described.

Figure 2:
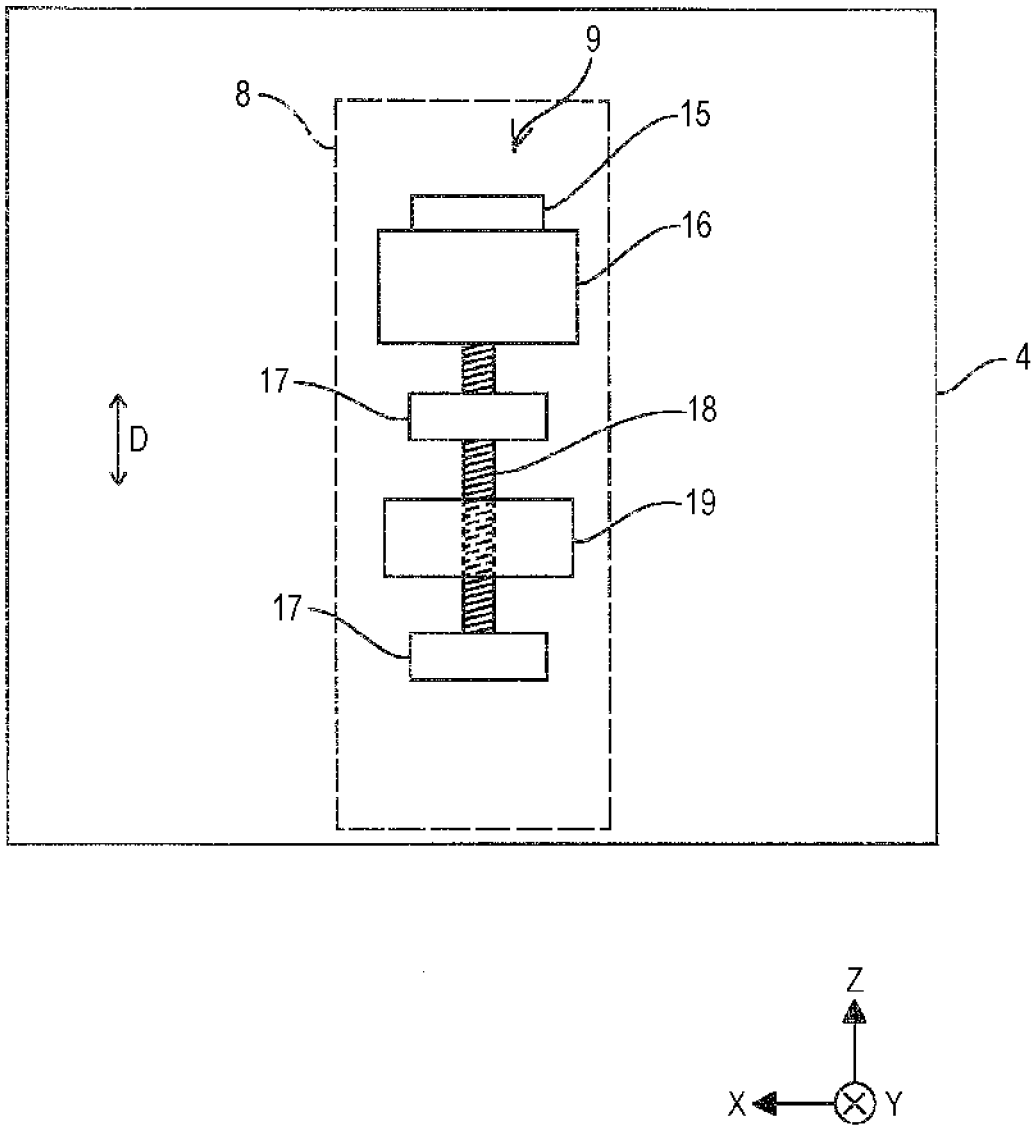
FIG. 2 is a schematic rear view illustrating an example of a moving section of a static eliminator in the recording apparatus.

FIG. 2 is a schematic rear view illustrating the moving section 9 for the static eliminator 8 in the recording apparatus 1 of one embodiment.

The static eliminator 8 is illustrated in broken lines for easy understanding of the configuration of the moving section 9.

In FIG. 2, a traveling nut 19 is attached to the static eliminator 8. A worm screw 18 is screwed into the traveling nut 19. The worm screw 18 is joined to the rotation shaft of the static eliminator moving motor 16 which is attached to the recording head 4 (and hence the carriage) similarly to supporting sections 17 and is rotatable in a normal direction and a reverse direction. That is, the worm screw 18 is rotatably fixed with respect to the recording head 4. Then, the static eliminator moving motor 16 is driven to cause the worm screw 18 to rotate in the normal direction and the reverse direction. By rotating the worm screw 18 in the normal and reverse directions, the static eliminator 8 moves with respect to the recording head 4 in the direction D (e.g., either towards or away from the recording medium P depending on the direction of rotation of the worm screw 18).

The static eliminator moving motor 16 is provided with a rotary encoder 15 that detects the amount of rotation of the worm screw 18 in the normal direction and the reverse direction.

Electric configuration of the recording apparatus 1 of this embodiment will be described.

Figure 3:
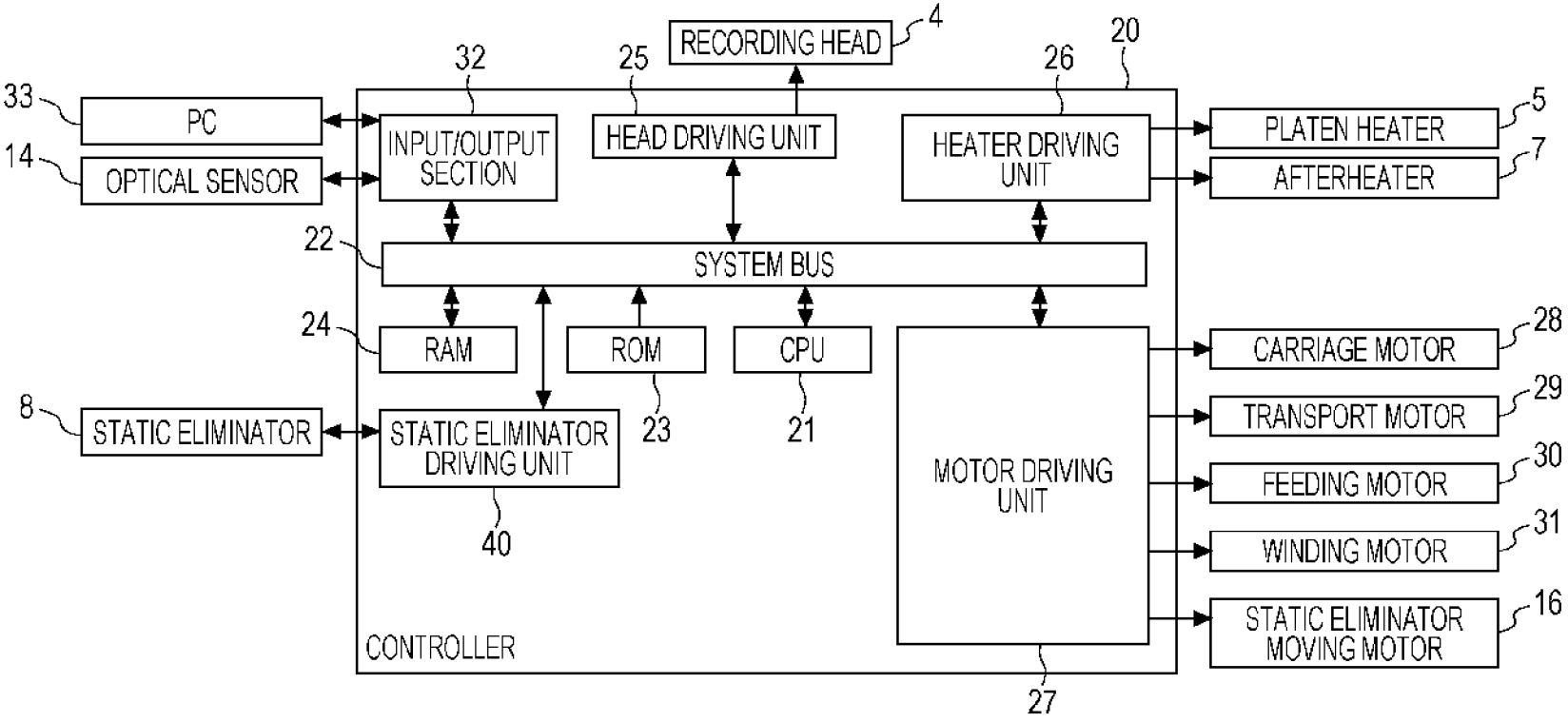
FIG. 3 is a block diagram of the recording apparatus.

FIG. 3 is a block diagram of the recording apparatus 1 of one embodiment.

The controller 20 includes a CPU 21 that controls the whole recording apparatus 1. The CPU 21 is connected via a system bus 22 to a ROM 23 that stores a variety of control programs to be executed by the CPU 21 and the like and a RAM 24 that may temporarily store data.

The CPU 21 is also connected via the system bus 22 to a head driving unit 25 for driving the recording head 4.

The CPU 21 is also connected via the system bus 22 to a heater driving unit 26 for driving the platen heater 5 and the afterheater 7.

The CPU 21 is also connected via the system bus 22 to a motor driving unit 27 for driving a carriage motor 28, a transport motor 29, a feeding motor 30, a winding motor 31, and a static eliminator moving motor 16.

The carriage motor 28 is a motor for moving the carriage incorporating the recording head 4. The transport motor 29 is a motor for driving a plurality of transporting rollers disposed on the transport mechanism 11. The feeding motor 30, is a rotation mechanism for the supporting shaft 2, and is a motor for driving the supporting shaft 2 so as to feed the recording medium P into the transport mechanism 11. The winding motor 31 is a driving motor for rotating the winding shaft 10. The static eliminator moving motor 16 is a motor for rotating the worm screw 18 in order to move the static eliminator 8 with respect to the recording head 4 in the direction D.

In addition, the CPU 21 is connected via the system bus 22 to an input/output section 32 connected to a PC 33 and the optical sensor 14 for sending/receiving data such as recording data or the like and signals.

The CPU 21 is connected via the system bus 22 to a static eliminator driving unit 40 for driving the static eliminator 8. The controller 20 controls the static eliminator driving unit 40 so as to control the driving of the static eliminator 8.

As used herein, "controlling the driving of the static eliminator 8" includes, other than on/off control of the static eliminator 8, for example, control of the intensity of the operation of the static eliminator 8 by following an instruction inputted by a user through the PC 33, or the like. In one example, the controller 20 may control both the position of the static eliminator 8 relative to the recording head 4 and/or the recording medium P and/or an intensity with which the static eliminator 8 is driven to remove or eliminate the electrostatic charge that may be present on the recording medium P.

In the recording apparatus 1 the controller 20 controls the driving of the static eliminator 8 so that static electricity is efficiently eliminated from the recording medium P. In addition, for example, the static eliminator 8 is turned off when the recording medium P is less likely to be electrostatically charged and when elimination of static electricity is unnecessary. This can reduce electricity costs. In addition, if the static eliminator 8 is continuously on, the static eliminator 8 is likely to be contaminated from airborne matter such as dirt, dust, and ink mist that attaches to the static eliminator 8. Therefore, when elimination of static electricity is unnecessary, for example, the static eliminator 8 is turned off. Turning off the static eliminator 8 inhibits or helps prevent the static eliminator 8 from being contaminated.

The controller 20 may receive, from the PC 33, information on a type of the recording medium P, information on an installation location of the recording apparatus 1, information on date and time, and/or information on environmental humidity. The controller 20 may control the driving of the static eliminator 8 based on at least one of information on the type of the recording medium P, information on the installation location of the recording apparatus 1, information on date and time, and/or information on the environmental humidity. Therefore, it may be easily recognized when the recording medium P is less likely to be electrostatically charged so that elimination of static electricity is unnecessary, on the basis of at least one of the type of the recording medium P, the installation location of the recording apparatus 1, and date and time and the environmental humidity. In one example, when it is recognized that the recording medium P is less likely to be charged and the elimination of static electricity is unnecessary, the static eliminator 8 may be turned off.

A recording apparatus of another embodiment will be described in detail with reference to the accompanying drawings.

Figure 4:
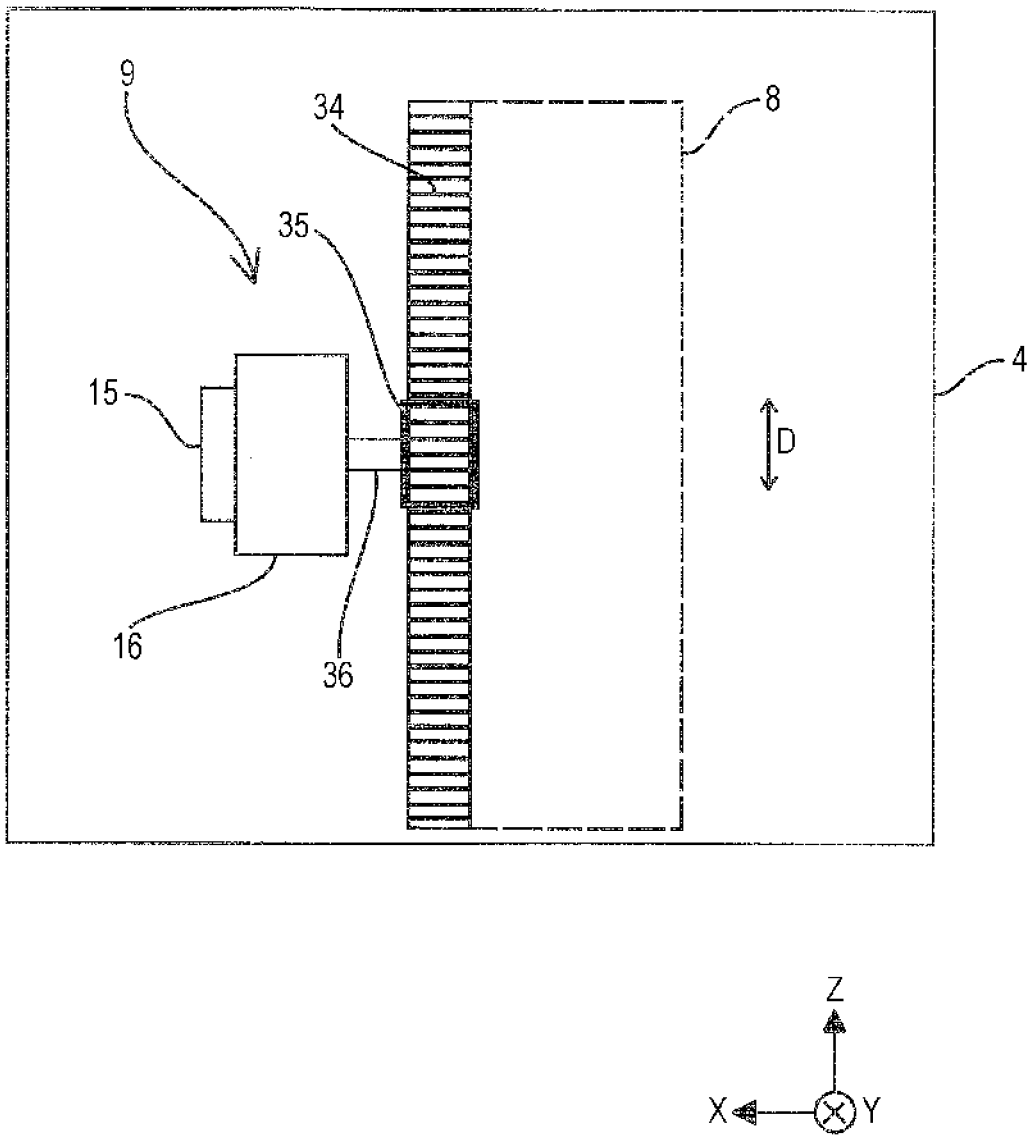
FIG. 4 is a schematic rear view illustrating another example of a moving section of a static eliminator in a recording apparatus.

FIG. 4 is a schematic rear view illustrating the moving section 9 for the static eliminator 8 in the recording apparatus of another embodiment. Components the same as those in the above embodiment are denoted by the same numerals, and detailed description thereof will be omitted.

The recording apparatus 1 of this embodiment has a similar configuration to the recording apparatus 1 of the first embodiment except for the configuration of the moving section 9.

As illustrated in FIG. 4, the static eliminator 8 may include a rack 34. The rack 34 is engaged with a pinion 35. The pinion 35 is attached to a rotation shaft 36 of a static eliminator moving motor 16, which is attached to the recording head 4

(and hence the carriage). The pinion 35 can rotate in the normal direction and the reverse direction. That is, the pinion 35 is rotatably fixed with respect to the recording head 4. Then, the static eliminator moving motor 16 is driven to cause the pinion 35 to rotate in the normal direction and the reverse direction. The static eliminator 8 moves with respect to the recording head 4 in the direction D in accordance with the rotation of the static eliminator moving motor 16.

The static eliminator moving motor 16 is provided with a rotary encoder 15 in one example that detects an amount of the rotation of the worm screw 18 in the normal direction and the reverse direction.

A recording apparatus of another embodiment will be described in detail with reference to the accompanying drawings.

Figure 5:
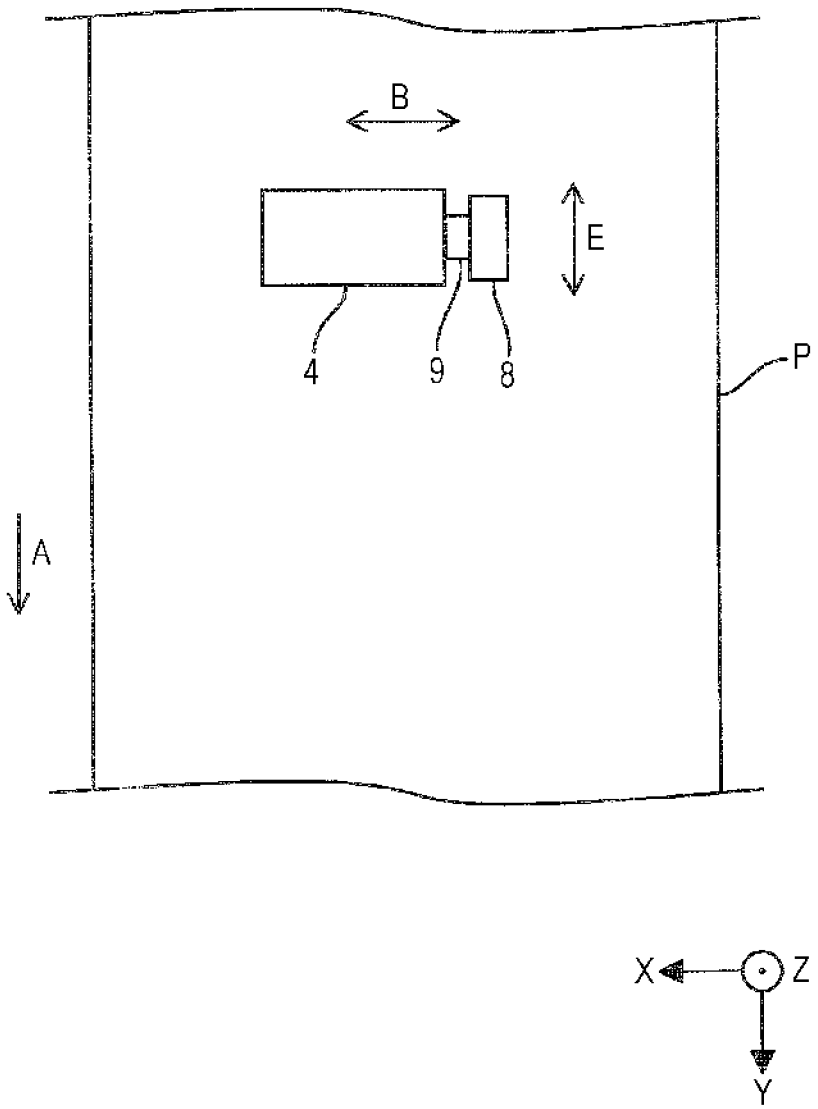
FIG. 5 is a schematic plan view illustrating another example of a position and a moving direction of a static eliminator with respect to a recording section of a recording apparatus.

FIG. 5 is a schematic plan view illustrating a position and a moving direction of a static eliminator 8 with respect to a recording head 4 in a recording apparatus. Components the same as those in the above embodiments are denoted by the same numerals, and detailed description thereof will be omitted.

The recording apparatus 1 of this embodiment has a similar configuration to the recording apparatus 1 of another embodiment except the location of the static eliminator 8 with respect to the recording head 4 and the position and the moving direction of the moving section 9.

As illustrated in FIG. 5, for example, in the recording apparatus 1 of this embodiment, the static eliminator 8 is disposed at one end of the recording head 4 in the direction B which is a direction in which the recording head 4 moves reciprocally. The moving section 9, which has the same configuration as the moving section in FIG. 1 and which turns 90 degrees from the position of the moving section in FIG. 1, may move the static eliminator 8 with respect to the recording head 4 in a direction E that is parallel to the transport direction A.

In other words, the recording apparatus 1 of this embodiment includes a transport mechanism 11 that transports the recording medium P. The moving section 9 may move the static eliminator 8 with respect to the recording head 4 in the transport direction A of the recording medium P. Therefore, the static eliminator 8 may be moved with respect to the recording head 4 to an appropriate position in the direction E parallel to the transport direction A. This may include movement in an upstream and/or a downstream direction of the transport direction.

The recording apparatus of another embodiment will be described in detail with reference to the accompanying drawings.

Figure 6:
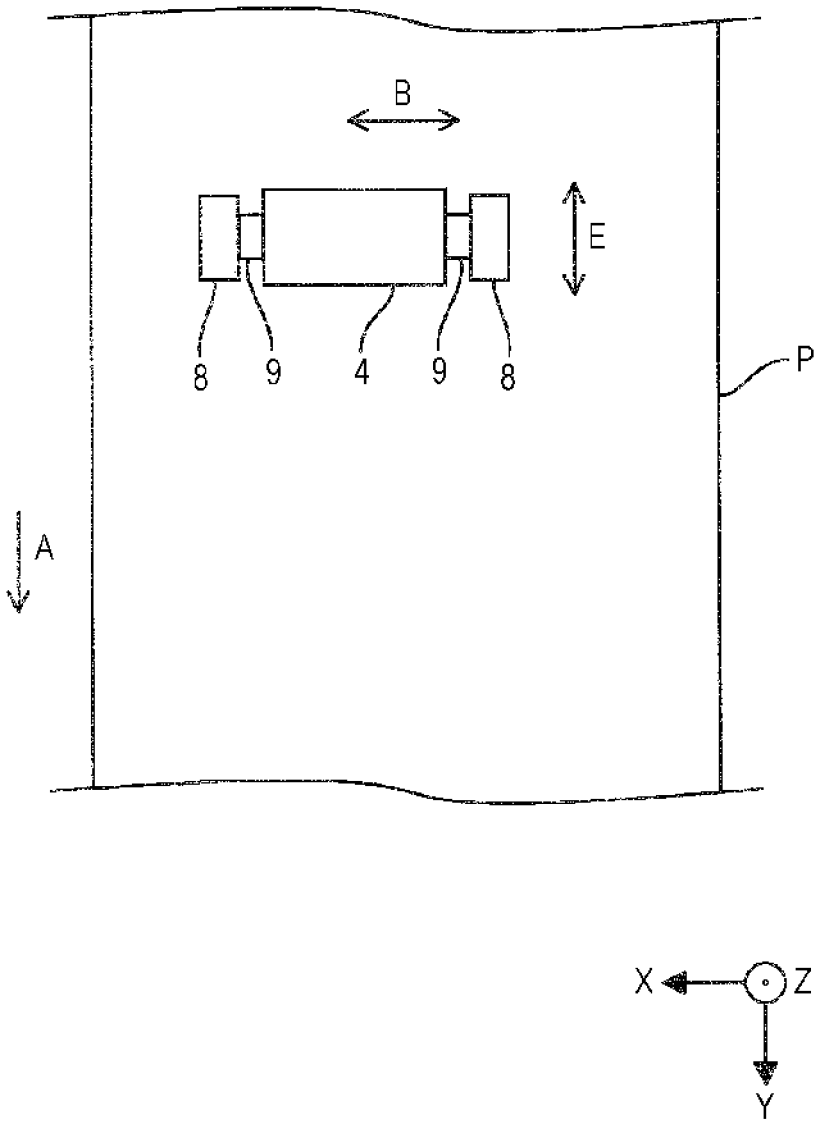
FIG. 6 is a schematic plan view illustrating another example of a position and a moving direction of a static eliminator with respect to a recording section of a recording apparatus.

FIG. 6 is a schematic plan view illustrating a position and a moving direction of a static eliminator 8 with respect to a recording head 4 in a recording apparatus of this embodiment. Components the same as those in the above embodiments are denoted by the same numerals, and detailed description thereof will be omitted.

The recording apparatus 1 of this embodiment has the same configuration as the recording apparatus 1 of FIG. 5 except that both the static eliminator 8 and the moving section 9 are disposed at each end of the recording head 4 in the direction B.

As illustrated in FIG. 6, the recording apparatus 1 of this embodiment includes both the static eliminator 8 and the moving section 9 are disposed at each end of the recording head 4 in the direction B or in the reciprocating direction. Each of the moving sections 9 may move the corresponding static eliminator 8 with respect to the recording head 4 in the direction E parallel to the transport direction A.

In other words, in the recording apparatus 1 of this embodiment, the static eliminator 8 is incorporated at each end of the recording head 4 in the direction B. Therefore, whichever direction along the direction B (either the leftward direction or the rightward direction in FIG. 6) the static eliminator 8 moves, the static eliminator 8 may efficiently eliminate static electricity from the recording medium P in an appropriate position in the transport direction A with respect to the recording head 4 immediately before the recording head 4 discharges ink. Therefore, contamination of the recording medium P caused by the attachment of ink mist may be efficiently inhibited.

The recording apparatus of another embodiment will be described in detail with reference to the accompanying drawings.

Figure 7:
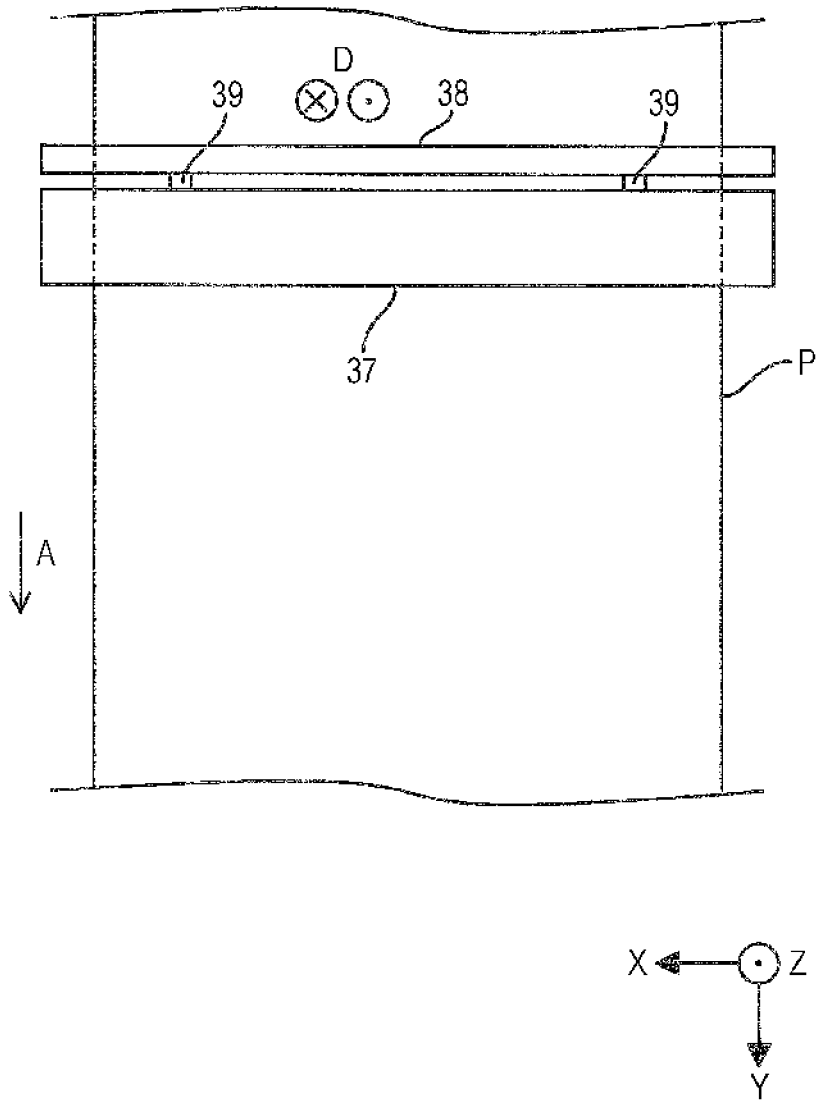
FIG. 7 is a schematic plan view illustrating another example of a recording apparatus

FIG. 7 is a schematic plan view illustrating a recording apparatus of this embodiment. Components the same as those in the above embodiments are denoted by the same numerals, and detailed description thereof will be omitted.

The recording apparatus 1 of this embodiment has the same configuration as the recording apparatus 1 of FIG. 1, except that the recording apparatus 1 includes a line head 37 functioning as a recording section and a static eliminator 38 extending in a direction intersecting with the transport direction A.

As illustrated in FIG. 7, the recording apparatus 1 includes the line head 37 functioning as a recording section and the static eliminator 38 extending in a direction intersecting with the transport direction A. Two moving sections 39 may move the static eliminator 38 with respect to the line head 37 in the direction D, but the recording apparatus 1 has a similar configuration to the moving section 9 in the recording apparatus 1 of FIG. 1.

The recording apparatus 1 of FIG. 7 in such a configuration may also efficiently inhibit contamination of the recording medium P as a result of airborne matter such as dirt, dust, and ink mist attaching to the recording medium P.

Another Embodiment

The recording apparatus shown in FIGS. 1, 4, and 7 includes the static eliminator 8 upstream of the recording head in the transport direction A of the recording medium P. However, for example, the static eliminator 8 may be positioned downstream of the recording head in the transport direction A in the recording apparatus having a configuration in which the recording medium P is set at a setting position located downstream of the recording head in the transport direction A, is subsequently moved upstream of the recording head in the transport direction A, and is subsequently transported.

In the above embodiments, the recording apparatus may move the static eliminator with respect to the recording section in one of the direction D and the direction E; however, the static eliminator may be moved in both the direction D and the direction E, or may be moved in another direction or may be moved in one or more directions.

What is claimed is:

1. A recording apparatus comprising:

a recording section that performs recording on a recording medium;

a static eliminator that eliminates static electricity from the recording medium;

a moving section that moves the static eliminator with respect to the recording section; and a detecting section that detects a distance between the recording medium and the recording section, wherein the moving section moves the static eliminator toward or away from the recording medium depending on the distance detected by the detecting section, and wherein the moving section is configured to modify relative positions of the static eliminator and the recording section.

2. The recording apparatus according to claim 1, further comprising:

a transport section that transports the recording medium, wherein the moving section moves the static eliminator in a transport direction of the recording medium.

3. The recording apparatus according to claim 2, wherein the recording section includes:

a recording head having a nozzle face in which nozzles for discharging inks are disposed; and a carriage that incorporates the recording head and reciprocally moves in a direction intersecting with the transport direction of the recording medium.

4. The recording apparatus according to claim 1, further comprising, a transport section that transports the recording medium, wherein the recording section includes:

a recording head having a nozzle face in which nozzles for discharging inks are disposed; and a carriage that incorporates the recording head and reciprocally moves in a direction intersecting with the transport direction of the recording medium.

5. The recording apparatus according to claim 4, wherein the static eliminator is incorporated in the carriage.

6. The recording apparatus according to claim 5, wherein the static eliminator is incorporated at each end of the recording head in the intersecting direction.

7. The recording apparatus according to claim 1, further comprising:

a controller that controls driving of the static eliminator.

8. The recording apparatus according to claim 7, wherein the controller controls the driving of the static eliminator using at least one of information on a type of the recording medium, information on an installation location of the recording apparatus, information on date and time, and information on environmental humidity.

* * * * *